US007354355B2

(12) United States Patent
Tavares et al.

(10) Patent No.: US 7,354,355 B2
(45) Date of Patent: Apr. 8, 2008

(54) GOLF CLUB HEAD OR OTHER BALL STRIKING DEVICE WITH MODIFIABLE FEEL CHARACTERISTICS

(75) Inventors: Gary G. Tavares, Azle, TX (US); Todd A. Waatti, Battleground, WA (US); Carl L. Madore, Portland, OR (US)

(73) Assignee: Nike, Inc., Beaverton, OR (US)

( * ) Notice: Subject to any disclaimer, the term of this patent is extended or adjusted under 35 U.S.C. 154(b) by 260 days.

(21) Appl. No.: 10/954,230

(22) Filed: Oct. 1, 2004

(65) Prior Publication Data

US 2006/0073908 A1 Apr. 6, 2006

(51) Int. Cl.
*A63B 53/04* (2006.01)
*A63B 53/06* (2006.01)

(52) U.S. Cl. ..... 473/329; 473/333; 473/334; 473/339; 473/340

(58) Field of Classification Search ..... 473/220–221, 473/251–255, 324–350
See application file for complete search history.

(56) References Cited

U.S. PATENT DOCUMENTS 690,940 A * 1/1902 Febiger ..... 473/333
1,825,244 A * 9/1931 Nero ..... 473/333
1,975,307 A * 10/1934 Ackerman ..... 473/333
2,592,013 A * 4/1952 Curley ..... 473/333
3,556,532 A * 1/1971 Ballmer ..... 473/332
3,589,731 A * 6/1971 Chancellor, Jr. ..... 473/333
4,123,056 A * 10/1978 Nakamatsu ..... 473/234
4,170,357 A * 10/1979 Greer ..... 473/333
4,191,378 A * 3/1980 Morin et al. ..... 473/224
4,283,057 A * 8/1981 Ragan ..... 473/234
4,461,481 A * 7/1984 Kim ..... 473/333
4,840,371 A * 6/1989 Harris ..... 472/56
4,898,389 A * 2/1990 Plutt ..... 473/223
5,000,454 A * 3/1991 Soda ..... 473/346
5,064,197 A * 11/1991 Eddy ..... 473/326
5,160,144 A * 11/1992 Maniatis ..... 473/251
5,169,151 A * 12/1992 Conley ..... 473/220
5,366,222 A * 11/1994 Lee ..... 473/333
5,464,211 A 11/1995 Atkins, Sr.
5,482,283 A * 1/1996 Wall ..... 473/220
5,643,109 A * 7/1997 Rose et al. ..... 473/329
5,718,641 A * 2/1998 Lin ..... 473/224
5,830,084 A * 11/1998 Kosmatka ..... 473/349

(Continued)

FOREIGN PATENT DOCUMENTS

EP 10033724 2/1998

(Continued)

OTHER PUBLICATIONS

International Search Report dated Jan. 24, 2006.

*Primary Examiner*—Sebastiano Passaniti
(74) *Attorney, Agent, or Firm*—Banner & Witcoff, Ltd.

(57) ABSTRACT

Ball striking devices, such as golf club heads (including putter heads), include devices within and/or otherwise engaged with the ball striking head that allow users to selectively change the sound and/or other aspects of the "feel" associated with using the ball striking device to strike a ball. In this manner, a user, a club fitter, or the like can freely customize and adjust the sound and/or other aspects of the ball striking device's feel to correspond to a particular user's preferences.

18 Claims, 4 Drawing Sheets

U.S. PATENT DOCUMENTS 5,868,633 A * 2/1999 Keheley ..... 473/220
5,890,973 A 4/1999 Gamble
5,908,357 A * 6/1999 Hsieh ..... 473/327
5,911,637 A * 6/1999 Yamagata ..... 473/333
5,913,709 A * 6/1999 Cyr et al. ..... 446/418
5,924,938 A * 7/1999 Hines ..... 473/307
6,309,311 B1 * 10/2001 Lu ..... 473/332
6,872,148 B2 * 3/2005 Lee ..... 473/131
2003/0083150 A1 5/2003 Pond et al.

FOREIGN PATENT DOCUMENTS

EP 10179814 7/1998
GB 2 249 031 A 4/1992
WO WO 99/22823 5/1999

* cited by examiner

GOLF CLUB HEAD OR OTHER BALL STRIKING DEVICE WITH MODIFIABLE FEEL CHARACTERISTICS

FIELD OF THE INVENTION

The invention relates generally to ball striking devices, such as golf club heads (including putter heads), that enable users, club fitters, club manufacturers, and the like to selectively control, change, and customize aspects of the "feel" associated with the ball striking device when it strikes a ball (or other similar object).

BACKGROUND

Golf is enjoyed by a wide variety of players—players of different genders, and players of dramatically different ages and skill levels. Golf is somewhat unique in the sporting world in that such diverse collections of players can play together in golf events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years both in the United States and across the world. The number of individuals participating in the game and the number of golf courses have increased steadily over recent years.

Golfers of all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instruments that set a golf ball in motion during play, golf clubs also have been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Golfers tend to be sensitive to the "feel" of a golf club, particularly with respect to putters. The "feel" of a golf club (or other ball striking device) comprises the combination of various component parts of the club and various features associated with the club that produce the sensory sensations experienced by the player when a ball is swung at and/or struck. Club weight, weight distribution, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, or decelerate the swing, thereby affecting distance, direction, and/or other performance aspects of the swing and the resulting ball motion. User anticipation of this unpleasant, undesirable, or surprising sound can affect a swing even before the ball is hit.

Every golfer's tastes and preferences with respect to "feel" aspects of a golf club differ. In other words, providing an acceptable golf club "feel" is not a "one size fits all" proposition. Accordingly, it would be advantageous to provide golf club heads and/or golf clubs, including putter heads and/or putters, that enable users to change, control, and customize various aspects of the club's "feel" to match their particular preference, liking, and/or swing characteristics. In some instances, it would be particularly advantageous to provide golf club heads and/or golf clubs, including putter heads and/or putters, that enable users to change, control, and customize the sound emanating from the club head when a ball is struck to suit their particular taste, liking, and/or swing characteristics.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to ball striking devices, such as golf clubs and golf club heads (including putters and putter heads) that include: (a) a ball striking head including a ball striking surface that faces a ball in use; and (b) means for changing a sound emanated by the ball striking head and/or another aspect of the "feel" associated with the ball striking head when a ball contacts the ball striking surface. The ball striking head further may include a body member that extends in a direction away from the ball striking surface toward a rear of the ball striking device. The sound and/or other aspects of the "feel" associated with the club head may be selectively changed and/or modified by a user, a club fitter, a club manufacturer, a club retailer, or the like, e.g., to control or customize the sound and/or other aspects of the feel to suit a particular user's preferences.

Additional aspects of this invention relate to ball striking devices that include: (a) a ball striking head including a ball striking surface that faces a ball in use; (b) at least one wall member, optionally defining a first chamber, located behind and/or extending in a direction away from the ball striking surface; and (c) means for applying a force to the wall member. The means for applying the force may be used to apply a compressive force and/or to otherwise change the stiffness of the wall member, e.g., to thereby change at least one characteristic of a response by the ball striking head when a ball contacts the ball striking surface. In at least some examples, the means for applying the force will be freely and selectively controllable by a user (or others), to thereby allow the user to change, control, and customize at least one characteristic of the ball striking device's response to suit his/her preferences, e.g., to change the tone, frequency, or pitch of the sound generated when the device strikes a ball. Additionally, if desired, the means for applying the force and/or the wall member may be selectively removable from the ball striking head and replaceable by another means for applying the force and/or another wall member, to thereby allow further user selectivity and customization, e.g., of the ball striking head's response, the sound generated, the club's weight, weight distribution, and/or swing characteristics, etc.

Still additional aspects of the invention relate to methods for using ball striking devices in accordance with examples of the invention (such as the devices described above) to control the sound and/or other aspects of the feel associated with a ball striking device when it contacts a ball in use. For example, methods according to at least some examples of this invention may include: (a) providing a ball striking device including a ball striking head (e.g., a putter head) having a ball striking surface that faces a ball in use, a means for changing a sound emanated by the ball striking head when a ball contacts the ball striking surface, and/or a means for changing other aspects of the feel associated with the ball striking head when a ball contacts the ball striking surface; and (b) adjusting the means for changing the sound and/or the means for changing the feel to thereby change the sound and/or feel associated with the ball striking head when a ball contacts the ball striking surface. Additional methods according to at least some examples of this invention may include: (a) providing a ball striking device, having: (i) a ball striking head (e.g., a putter head) including a ball striking surface that faces a ball in use, (ii) at least one wall member, optionally defining a first chamber, located behind and/or extending in a direction away from the ball striking surface, and (iii) means for applying a force to the wall member; and (b) adjusting the means for applying the force to the wall member to thereby change a characteristic of a response by the ball striking head when a ball contacts the ball striking surface (e.g., change a sound characteristic).

Methods according to at least some examples of the invention further may include the use of selectively removable means for changing, means for applying, and/or removable weighted members, e.g., to allow further adjustment and customization of the swing characteristics and/or feel of the ball striking device.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
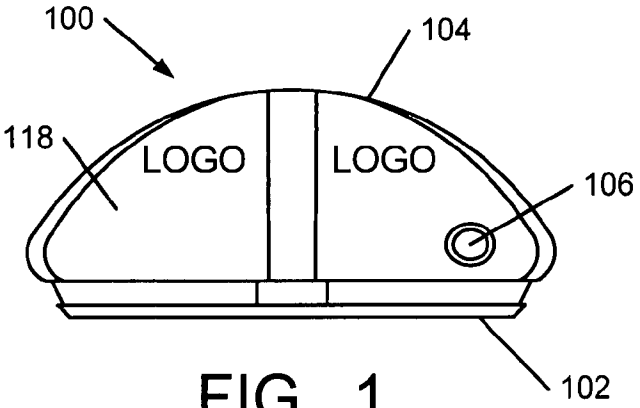
FIGS. 1-4 illustrate top, bottom, front, and rear views, respectively, of a ball striking device in the form of a putter according to an example of this invention.

In the following description of various example embodiments of the invention, reference is made to the accompanying drawings, which form a part hereof, and in which are shown by way of illustration various example structures, devices, systems, and environments in which aspects of the invention may be practiced. It is to be understood that other specific arrangements of parts, structures, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Ball Striking Devices According to Aspects of the Invention; Specific Examples of the Invention; and Conclusion.

A. Terms

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

"Feel" means the combination of the various component parts of a ball striking device and the various features associated with the device (such as material types, dimensions, hardness, etc.) that produce the sensory sensations experienced by the user when the user swings at and/or strikes a ball (or other object).

The terms "shaft" and "handle" are used synonymously and interchangeably in this specification, and they include the portion of a ball striking device (if any) that the user holds during a swing of a ball striking device.

B. General Description of Ball Striking Devices According to Aspects of the Invention In general, aspects of this invention relate to ball striking devices, such as golf club heads, golf clubs, putter heads, putters, and the like. Such ball striking devices, according to at least some examples of the invention, may include: (a) a ball striking head including a ball striking surface that faces a ball in use; and (b) means for changing a sound emanated by the ball striking head when a ball contacts the ball striking surface. The ball striking head further may include a body member that extends from the ball striking surface toward a rear of the ball striking device.

The means for changing the sound may be engaged with some portion of the ball striking head, such as the body member and/or the ball striking surface. In some examples, the means for changing the sound actually may be at least partially included within an open region defined in the body member and/or at least partially exposed to the user (or others) through an opening provided in the body member. In at least some examples of the invention, a user may selectively change a feature or orientation of the means for changing the sound, such as rotate it, change its position or orientation, or the like, to thereby change the sound emanating from the ball striking head when it contacts a ball in use.

Ball striking devices (including putter heads and putters) in accordance with at least some examples of this invention further may include one or more weighted members that are engaged with and/or included in the ball striking device (e.g., engageable with and/or included in the body member of the ball striking device). Such weighted members may be selectively removable, and optionally replaceable by different weighted members, to allow users, club fitters, and the like to selectively change the swing characteristics and/or other "feel" aspects associated with the ball striking device (e.g., to suit a particular user's tastes, preferences, swing characteristics, etc.). In at least some examples of the invention, the means for changing the sound also may act as a weighted member for a ball striking device, and it may be selectively changed with one of different weight or weight distribution to further change the "feel" characteristics of the device, as described above.

The means for changing the sound may function in various ways without departing from the invention. For example, in some devices, the means for changing the sound may change a stiffness or pressure applied to an interior wall member in the ball striking device, to thereby change the tone, frequency, pitch, or other characteristic of the sound issued when a ball contacts the ball striking surface. As another example, at least a portion of the means for changing the sound may contact and/or apply a force directly against a backside of the ball striking face to thereby change the vibrational characteristics of the device (and thus the sound emanated by the device) when the ball contacts the ball striking face. As yet another example, one or more intermediate members may be provided between the means for changing the sound and the ball striking face, and thus the intermediate member(s) may be responsible for applying pressure to and/or otherwise changing the vibrational characteristics and/or sound characteristics of the device. As still another example, changing intermediate members or wall members, or adding one or more of these elements to the overall structure, and/or changing their size, shape, weight, weight distribution, dimensions, materials, or the like, may be used to change the sound emanating from the device when a ball is struck.

Additional aspects of this invention relate to ball striking devices, such as golf clubs, putters, golf club heads, putter heads, and the like, in which the "feel" of the club (e.g., its swing characteristics, sound characteristics, etc.) may be changed to suit a particular user's likings or preferences. Such ball striking devices, according to at least some examples of the invention, may include: (a) a ball striking head including a ball striking surface that faces a ball in use; and (b) means for changing a feel associated with the ball striking head when a ball contacts the ball striking surface. The ball striking head further may include a body member that extends from the ball striking surface toward a rear of the ball striking device.

The means for changing the feel associated with the ball striking head may be engaged with some portion of the ball striking head, such as the body member, the ball striking surface, or the like. In at least some examples, the means for changing the feel actually may be included within an open region defined in the body member and/or partially exposed to the user (or others) through an opening provided in the body member. In at least some examples of the invention, a user may selectively change a feature of the means for changing the feel, such as rotate it, change its position, change its orientation, or the like, to thereby change the "feel" of the ball striking device as the ball striking head contacts a ball in use.

Ball striking devices (including putter heads and putters) in accordance with at least some examples of this aspect of the invention further may include one or more weighted members that are engaged with and/or included as part of the ball striking device (e.g., engageable with and/or included in the body member of the ball striking device), as described above. In at least some examples of the invention, the means for changing the feel also may act as a weighted member for a ball striking device.

The means for changing the feel may function in various ways without departing from the invention. For example, in some devices, the means for changing the feel may contact and/or apply a force directly against a backside of the ball striking face to thereby change the amount of "give" in the face when it strikes the ball. The "feel" also may be changed by changing the sound emanated by the device when it strikes a ball. As another example, one or more intermediate members or separate wall members may be provided as part of the means for changing the feel, e.g., adjacent to the ball striking face. As still another example, changing intermediate member(s) or wall member(s), adding one or more to the overall structure, and/or changing their size, shape, weight, weight distribution, dimensions, materials, etc., may be used to change the overall feel associated with the device when a ball is struck.

Still additional aspects of this invention relate to ball striking devices (such as golf clubs, golf club heads, putters, putter heads, and the like) that include: (a) a ball striking head including a ball striking surface that faces a ball in use; (b) at least one wall member, optionally defining a first chamber, located behind and/or extending in a direction away from the ball striking surface; and (c) means for applying a force to the wall member. The means for applying the force may take on any desired form without departing from the invention. For example, it may be housed within the ball striking head, and optionally within the first chamber. As additional examples, it may include a screw or other rotatable member that applies a compressive force to and/or or otherwise changes the stiffness of the wall member, to thereby change at least one characteristic of a response by the ball striking head when a ball contacts the ball striking surface.

The means for applying the force, in at least some examples, will be freely and selectively controllable by a user (or others), to thereby allow the user to change and customize at least one characteristic of the ball striking response to suit his/her preferences or likings. If desired, the ball striking head may include an opening defined therein to allow user access to the means for applying the force. Additionally, if desired, the means for applying the force and/or the wall member may be selectively removable from the ball striking head and replaceable by another means for applying the force and/or another wall member, to thereby allow further user selectivity and customization, e.g., of the ball striking head's response, of the club's weight, weight distribution, and/or swing characteristics, etc. As some more specific examples, a user may change the force applied by the means for applying the force to thereby change the sound emanated by or other feel characteristics of the ball striking head (e.g., to change a tone, frequency, or pitch of the sound produced by the ball striking head when a ball is struck).

Additional aspects of the invention relate to methods for using ball striking devices in accordance with the invention (such as the devices described above) to control the sound and/or other aspects of the feel associated with a ball striking device when contacting a ball in use. For example, methods according to at least some examples of this invention may include: (a) providing a ball striking device including a ball striking head having a ball striking surface that faces a ball in use and a means for changing a sound emanated by the ball striking head when a ball contacts the ball striking surface; and (b) adjusting the means for changing the sound to thereby change the sound emanated by the ball striking head when a ball contacts the ball striking surface. As another example, methods according to at least some examples of this invention may include: (a) providing a ball striking device including a ball striking head having a ball striking surface that faces a ball in use and a means for changing a feel associated with the ball striking head when a ball contacts the ball striking surface; and (b) adjusting the means for changing the feel to thereby change the feel associated with the ball striking head when a ball contacts the ball striking surface. Methods according to at least some examples of the invention further may include the use of selectively removable means for changing the sound or feel and/or removable weighted members, e.g., to allow further adjustment and customization of the sound, swing characteristics, and/or other aspects of the feel associated with the ball striking device.

Additional method aspects according to at least some examples of this invention may include: (a) providing a ball striking device, having: (i) a ball striking head (e.g., a putter head) including a ball striking surface that faces a ball in use, (ii) at least one wall member, optionally defining a first chamber, located behind and/or extending in a direction away from the ball striking surface, and (iii) means for applying a force to the wall member; and (b) adjusting the means for applying the force to the wall member to thereby change a characteristic of a response by the ball striking head when a ball contacts the ball striking surface. Any desired means for applying the force may be used without departing from the invention, such as a rotary screw member that applies pressure or a compressive force to the wall member and/or otherwise changes the stiffness of the wall member to thereby change the sound or other "feel" characteristics associated with the ball striking device during use. The means for applying the force may be of the general types described above (and described below in more detail).

Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of ball striking devices and components thereof useful as examples of this invention and useful in methods according to examples of this invention. When the same reference number appears in more than one drawing, that reference number is used consistently in this specification and the drawings to refer to the same or similar parts throughout.

At least some example embodiments of ball striking devices according to this invention relate to golf club head structures, including putter heads. Such devices may include a multiple piece construction and structure. A first example of a ball striking device according to this invention will be described in detail below in conjunction with FIGS. 1-4.

FIGS. 1-4 illustrate top, bottom, front, and rear views, respectively, of an example ball striking device in the form of a putter or putter head 100 according to an example of this invention. The putter head 100 includes a ball striking surface 102 located at its front and a body member 104 located behind and extending in a direction back and away from the ball striking surface 102. The body member 104 may be attached to the ball striking surface 102 in any desired manner without departing from the invention, e.g., by adhesives, screws, rivets, other mechanical connectors, etc. As another option, the ball striking surface 102 and at least some portion of the body member 104 may be formed as a unitary, one-piece construction without departing from the invention. The ball striking surface 102 faces and contacts a ball during use of the ball striking device 100 as is conventional and known in the art. A handle or shaft 106 may be engaged with the putter head 100, e.g., via threaded attachments, adhesives, mechanical connectors, and/or in any other desired manner, including in conventional manners known in the art.

The ball striking surface 102, the body member 104, shaft 106, and/or other portions of the putter head 100 may be made from any desired material, including combinations of different materials, without departing from the invention, including from conventional materials known and used in the art. Examples of suitable materials include: aluminum, titanium, steel, brass, copper, pewter, carbon fiber, polymers, etc. Additionally, the putter head 100 may have any desired construction without departing from the invention. For example, the overall exterior of the body member 104 may be in multi-piece form (e.g., including a base and a cover member joined together in any desired manner), wherein an open area or chamber is defined within the body member 104 and/or between the various pieces thereof. As another example, the body member 104 may be cast, molded, or otherwise formed as a single piece, optionally with one or more hollowed out portions or otherwise formed so as to define an interior chamber. The club head 100 may be in a "blade" form, a "mallet" form, or in any other head shape, including conventional head shapes, without departing from the invention. Logos, product names, manufacturer's names, or other indicia may be printed, engraved, and/or otherwise included as part of the club head design, on any desired surface, without departing from the invention, e.g., in conventional manners known in the art.

Figure 2:
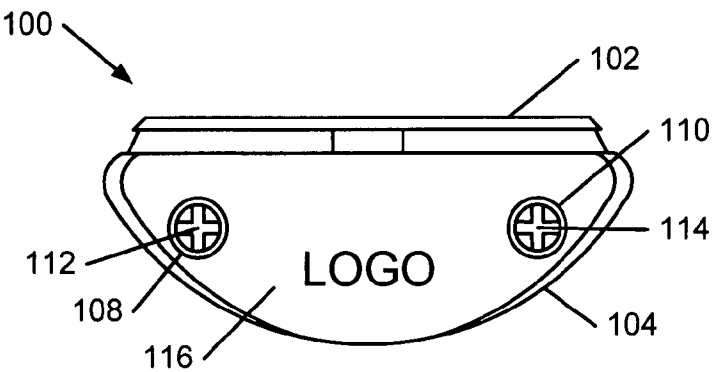
Figure 3:
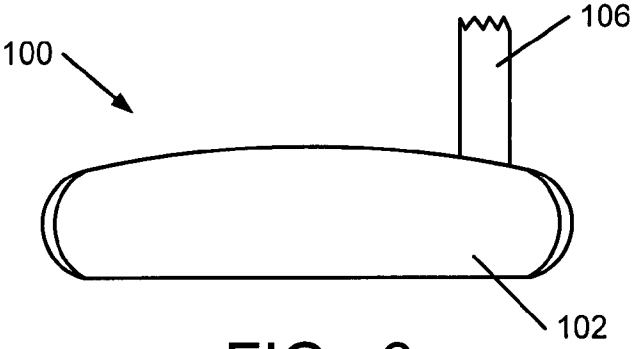

The bottom view of the putter head 100 shown in FIG. 2 illustrates an additional optional feature provided in at least some examples of the invention. Specifically, this bottom view illustrates two receptacles 108 and 110 into which weighted members 112 and 114 are inserted, respectively. These weighted members 112 and 114 may be freely removable from the putter head 100 and changed by the user, e.g., with lighter or heavier weighted members, so as to change the weight, weight distribution, swing characteristics, and/or other aspects of the feel associated with the golf club, for example, to customize the club to a specific user's preferences, to better correspond to current playing conditions (e.g., fast v. slow greens, dry v. wet conditions, etc.), etc. While shown attached at the bottom surface 116 of the club head 100 in this example, such weighted members may be provided at any desired location without departing from the invention, including on the top surface 118, on the side surface 120, as part of the shaft or handle 106, and/or in any combination of the above. Additionally, weighted members 112 and 114 may attach to the club head 100 or shaft 106 in any desired manner without departing from the invention, such as by threaded engagement, turnbuckles, clasps, clamps, or other mechanical or adhesive connections. For weighted members with adhesive and/or certain mechanical attachment systems, weighted member receptacles 108 and/or 110 may not be necessary, depending on the weighted member and/or attachment system design. As an additional example, if desired, one or more weighted members may be included in an interior chamber defined within the body member 104 (optionally with means to allow user access to the interior chamber for removal and weight customization purposes) without departing from the invention.

Figure 4:
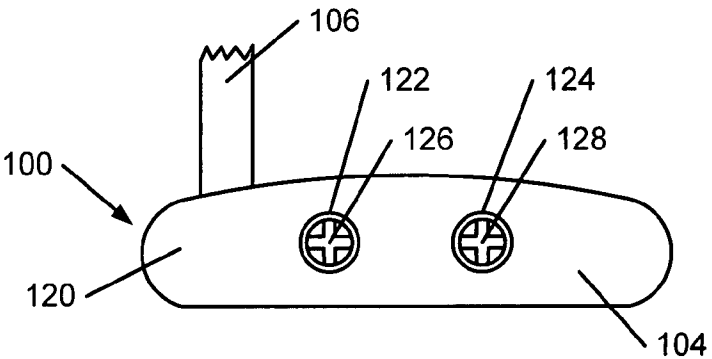

Another "feel" customization and/or adjustment feature available according to examples of this invention is illustrated in FIG. 4. Specifically, FIG. 4 illustrates that the club head 100 (specifically, the illustrated body member 104) includes openings 122 and 124 for receiving "means for changing the feel" of the club head 100 and/or for allowing access to this "means." Optionally, if desired, cover members may be provided to close up the openings 122 and 124 (e.g., frictional fit plugs, covers with mechanical closures, spring-biased cover members, etc.). Elements 126 and 128 for changing the "feel" of the golf club head 100 are engaged with the club head 100, e.g., inserted in openings 122 and 124, respectively, and are received in a chamber provided within the body member 104 in this illustrated example. In the illustrated example, the openings 122 and 124 allow access to the elements 126 and 128 so that a user (e.g., a club fitter, the golfer, a manufacturer, a retailer, etc.) can selectively change various "feel" characteristics associated with the club head 100 (e.g., by rotating screw elements in the illustrated example) for "feel" customization purposes, to suit a particular user's preferences, to better match play conditions, etc. More specific examples of structures and the like that may form a "means for changing the feel" of a ball striking device head 100 are described in more detail below in conjunction with FIGS. 5-13.

The "feel" of a ball striking device (e.g., a golf club or the club head) is governed by numerous factors and characteristics associated with the overall device. Thus, the "feel" of a club may be changed in numerous ways in examples of the invention. For example, changing an overall weight of the club head 104 and/or the location of the weight (i.e., its weight distribution) may be used to change the "feel" of the club. As another example, changing the "sound" associated with hitting a ball on the ball striking surface 102 also can change the "feel" of the club (e.g., a metallic "ring" sound versus a softer "thud" sound, etc.). As still another example, changing the rebound effect of the ball from the ball striking surface 102 also can change the "feel" of the club (e.g., hard ball contact and rebound versus a softer, more absorptive ball contact and rebound). The present invention allows users to change one or more of the "feel" characteristics of a ball striking device 100, which allows them to control, change, and customize the club's feel to their particular preferences.

Figure 6:
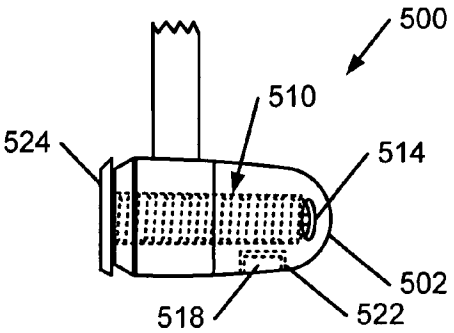
FIGS. 5 and 6 illustrate examples of various internal features of a ball striking device according to some examples of the invention, including an example means for changing a feel associated with the device.
Figure 5:
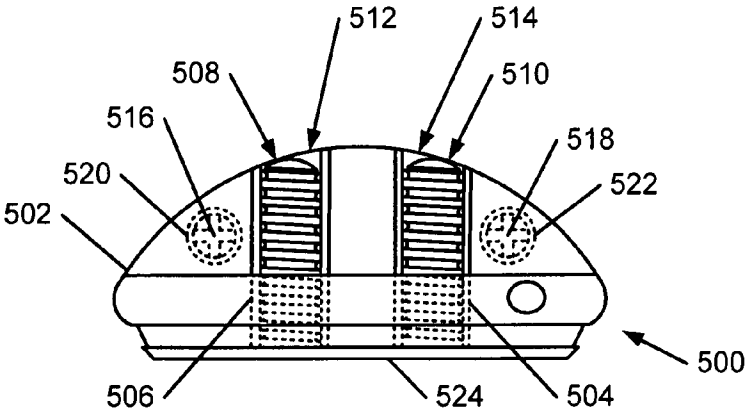

FIGS. 5 and 6 illustrate additional details of an example ball striking device head 500, e.g., like the one illustrated in FIGS. 1-4, but in this example, a cover and/or the top surface of the body member 502 is removed (and/or at least some portion of the body member 502 is not shown) to better illustrate example interior structures of the head 500. As shown, the body member 502 includes one or more internal walls 504 and 506 that define open areas for receiving means for changing the feel 508 and 510 associated with the club head 500. Openings 512 and 514 defined in the body member 502 (or its cover) allow user access to the means for changing the feel 508 and 510. Optionally, these openings 512 and 514 may be sized and oriented to allow for removal of all or some portion of the means for changing the feel 508 and 510 from the body member 502, e.g., for customization purposes, repair purposes, to change weight characteristics, to change weight distribution characteristics, etc. Additional structural details regarding some examples of "means for changing the feel" will be described in more detail below, in conjunction with FIGS. 11-13.

The example structure illustrated in FIGS. 5 and 6 additionally includes weighted members 516 and 518 and their respective receptacles 520 and 522 (shown in broken lines as these elements are hidden in these views). These weighted members 516 and 518 are freely removable from the receptacles 520 and 522 and may be interchanged with other weighted members (e.g., of different weight, weight distribution, etc.), e.g., to allow further customization of the feel associated with the club head 500. For example, the weighted members 516 and 518 may include threads that engage threads provided in the receptacles 520 and 522, respectively. Alternatively, friction fits, turnbuckles, hooks, clasps, clamps, covers, and/or other mechanical type connectors or retainers may be used to hold weighted members to a club head without departing from the invention. Also, while pairs of "means for changing the feel" 508 and 510 and weighted members 516 and 518 are shown in the illustrated example, any number of "means for changing the feel" and/or weighted members may be included in a ball striking device design without departing from the invention.

While various features of example "means for changing the feel" will be described below in conjunction with FIGS. 11-13, some additional features for potentially affecting the "feel" of a ball striking device are illustrated in FIGS. 5 and 6. For example, as shown, at least some portions of the means for changing the feel 508 and 510 of this example structure directly contact a backside of the ball striking surface 524. In this manner, the means for changing the feel 508 and 510 may affect the feel associated with the club head 500 in various ways. For example, the direct contact with the backside of the ball striking surface 524, as well as the presence of the means for changing the feel 508 and 510 in open areas of the club head body 502, may affect the sound generated by the ball striking surface 524 when it contacts a ball (e.g., by changing the vibrational characteristics of the club head 500 associated with this contact). This direct contact also may be used to change the rebound effect as a ball contacts and bounces off the surface 524 (e.g., depending on the pressure of the contact between the means for changing the feel 508 and 510 and the backside of the ball striking surface 524, a harder or softer rebound effect may be realized). Additionally, the presence, absence, changes in structure, changes in material, and/or other features associated with the means for changing the feel 508 and/or 510 may be used to change the sound, weight characteristics, weight distribution, and/or other aspects of the "feel" associated with the club head 500.

Optionally, if desired, the receptacles 520 and 522 for receiving the weighted members 516 and 518 and/or the receptacles for receiving the means for changing the feel 508 and 510 may be formed as one or more boreholes drilled into a solid head structure (or a solid portion thereof). All or just some portions of the body member 502 may be formed as a solid, one-piece construction, optionally integrally formed with the ball striking surface 524.

Figure 8:
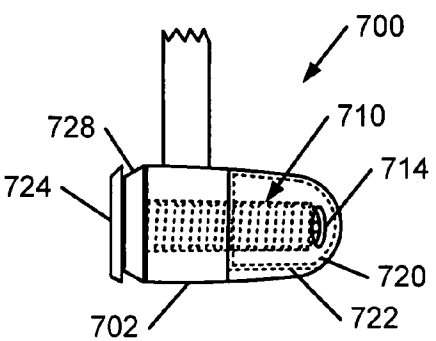
FIGS. 7 and 8 illustrate examples of various internal features of a ball striking device according to some examples of the invention, including another example means for changing a feel associated with the device.
Figure 7:
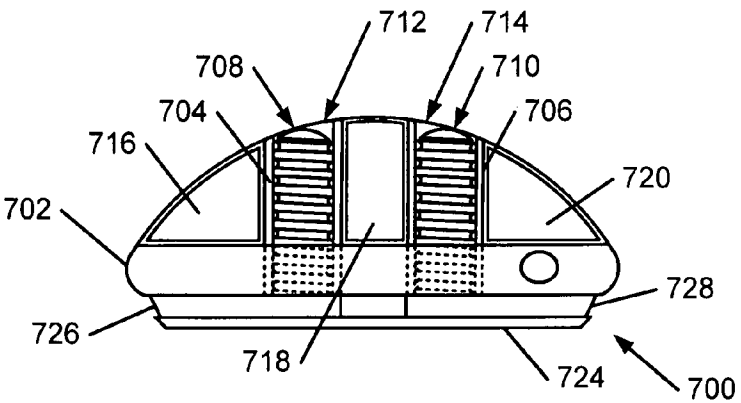

FIGS. 7 and 8 illustrate another example structure of a ball striking device head 700 according to at least some examples of the invention. In this example head structure 700 (shown again with a cover member and/or at least some portion of the body member 702 not shown to better illustrate example interior structures of the head 700), one or more internal walls 704 and 706 are provided to define open areas for receiving means for changing the feel 708 and 710 associated with the club head 700. These internal walls 704 and 706 essentially may form tubes or chambers into which the means for changing the feel 708 and 710 (or portions thereof) may be inserted. Openings 712 and 714 defined in the body member 702 (or its cover) allow user access to the means for changing the feel 708 and 710. Optionally, these openings 712 and 714 may allow for removal of all or some portion of the means for changing the feel 708 and 710 from the body member 702, e.g., for customization purposes, weight distribution purposes, weight changing purposes, repair purposes, etc.

In this example structure, rather than providing weighted members in the form of external and mechanically attachable inserts 516 and 518 as shown in FIGS. 5 and 6, one or more internal weighted members are provided (e.g., weighted members 716, 718, and 720 in FIGS. 7 and 8). These weighted members 716, 718, and 720 may fit within recesses or chambers provided or defined within body member 702, optionally on a "shelf" or other support member (e.g., support 722). If desired, the club head 700 may be designed such that users can have selective access to these interior chambers so that the weighted members 716, 718, and/or 720 can be selectively changed, removed, added, or otherwise modified, without departing from the invention. For example, the club head body 702 may be formed from multiple pieces held together by screws, bolts, adhesives, clamps, clasps, or other suitable mechanical connectors so as to allow user access to the interior chambers (e.g., by selectively removing a cover from the remainder of the body member 702).

In this illustrated example, the means for changing the feel 708 and 710 do not extend all the way to the backside of the ball striking surface 724, as was the case in the example illustrated in FIGS. 5-6. Rather, in this example structure, the means for changing the feel 708 and 710 terminate at intermediate members 726 and 728. If desired, intermediate members 726 and 728 can act, at least in part, as means for changing the feel of the club. For example, if desired, the club head 700 may be constructed such that intermediate members 726 and 728 are selectively removable, interchangeable for other intermediate members 726 and 728, etc. By changing intermediate members 726 and 728 (e.g., changing weights, weight distribution, thicknesses, types of materials, etc.), by changing the pressure applied to them by the means for changing the feel 708 and 710, and the like, the overall feel of the club head 700 may be changed when a ball is struck. For example, the sound, rebound effect, weight, weight distribution, and/or other characteristics of the club head 700 may be controlled and freely selected by the user, e.g., by changing intermediate members 726 and 728 and/or the pressure applied to them, etc.

Of course, any number of weighted members, intermediate members, and/or other means for changing the feel associated with the club head 700 may be included in a club head structure 700 without departing from the invention. Also, not all example structures in accordance with this invention need include all of the weighted members, the intermediate members, and/or other means for changing the feel shown in FIGS. 7 and 8. For example, if desired, the means for changing the feel (e.g., elements 708 and 710) also may act as "weighted members," and means for changing the feel elements 708 and 710 of different weights may be inserted via openings 712 and 714 to thereby change the overall weight, weight distribution, and/or swing characteristics of the club head 700, if desired. Such changes also may change the sound associated with the club head when a ball is struck. Also, as another example, if desired, the intermediate members 726 and 728 may be eliminated without departing from the invention.

Figure 10:
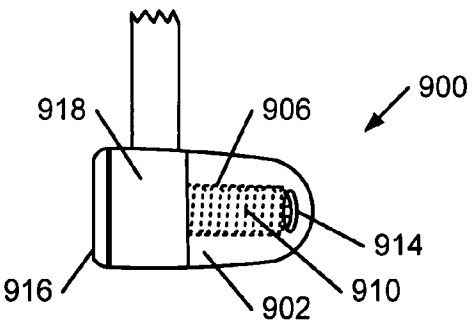
FIGS. 9 and 10 illustrate examples of various internal features of a ball striking device according to some examples of the invention, including another example means for changing a feel associated with the device.
Figure 9:
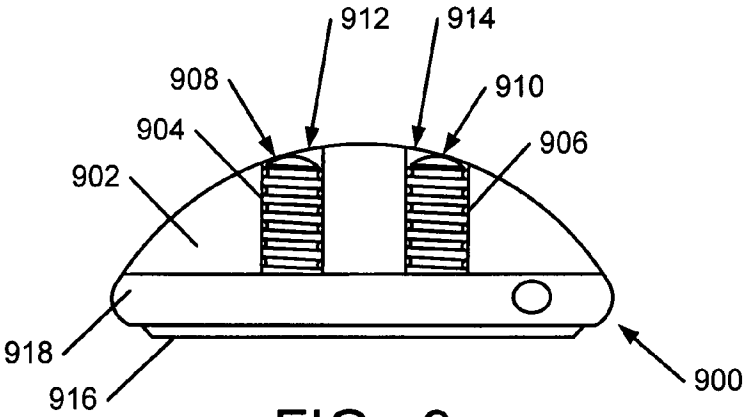

FIGS. 9 and 10 illustrate still another example of a ball striking device head 900 according to at least some examples of the invention. In this example head structure 900 (shown again with a cover member and/or at least some portion of the body member 902 not shown to better illustrate example interior structures of the head 900), open areas 904 and 906 are defined for receiving means for changing the feel 908 and 910 associated with the club head 900. These internal open areas 904 and 906 may be provided in any desired manner without departing from the invention. In this illustrated example, open areas 904 and 906 are formed as holes or bores (e.g., drilled) into which the means for changing the feel 908 and 910, respectively, may be inserted. Openings 912 and 914 defined in the body member 902 (or its cover) allow user access to the open areas 904 and 906, respectively, and thus to the means for changing the feel 908 and 910, respectively, contained within the open areas 904 and 906. Optionally, these openings 912 and 914 may be covered and/or may allow for removal of all or some portion of the means for changing the feel 908 and 910 from the body member 902, e.g., for customization purposes, repair purposes, weight control purposes, weight distribution purposes, etc.

In this example structure, no separate weighted members other than the means for changing the feel 908 and 910 are provided, although additional separate weighted members, like those described above in conjunction with FIGS. 5-8, may be provided without departing from the invention.

The means for changing the feel 908 and 910 in this illustrated example do not extend all the way to the ball striking surface 916. Rather, in this example structure, the means for changing the feel 908 and 910 terminate at an intermediate member 918. If desired, intermediate member 918 can act, at least in part, as means for changing the feel of the club head 900. For example, if desired, the club head 900 may be constructed such that intermediate member 918 may be selectively removable and interchangeable for one or more other intermediate member(s) 918, etc. By changing intermediate member 918 (e.g., changing weights, weight distribution, thicknesses, types of materials, hardness, etc.), the pressure applied to the intermediate member 918 by the means for changing the feel 908 and 910, and the like, the overall feel of the club head 900 may be changed when a ball is struck. For example, the sound, rebound effect, weight, weight distribution, and/or other characteristics of the club head 900 may be controlled and freely selected by the user, e.g., by changing intermediate member 918 and/or the pressure applied to it, etc.

Of course, any number of intermediate members and/or other means for changing the feel (including separate weighted members) may be included in the club head structure 900 without departing from the invention. Also, as described above, the means for changing the feel (e.g., elements 908 and 910) may act as "weighted members," and means for changing the feel of different weights and/or weight distributions may be inserted via openings 912 and 914 to thereby change the overall weight, weight distribution, and/or other swing characteristics of the club head 900, if desired.

Figure 11:
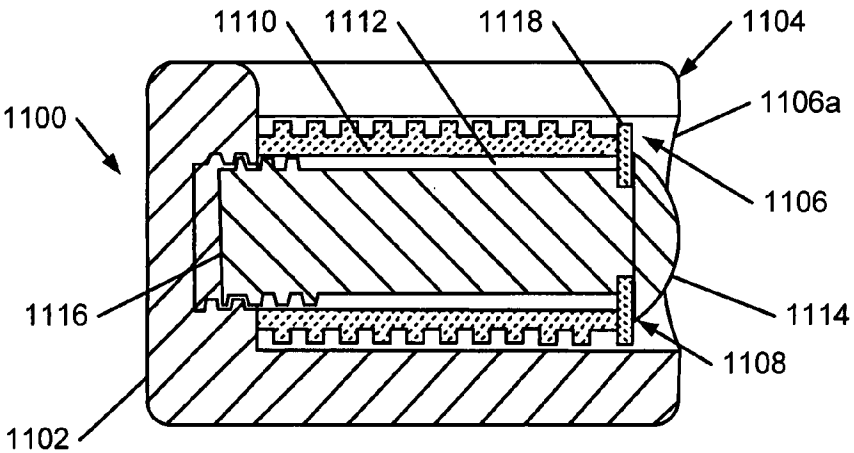
FIGS. 11-13 illustrate example features of various examples of means for changing a sound associated with a ball striking device, including various examples of means for applying pressure or force to wall members included as part of a means for changing the sound.
Figure 12:
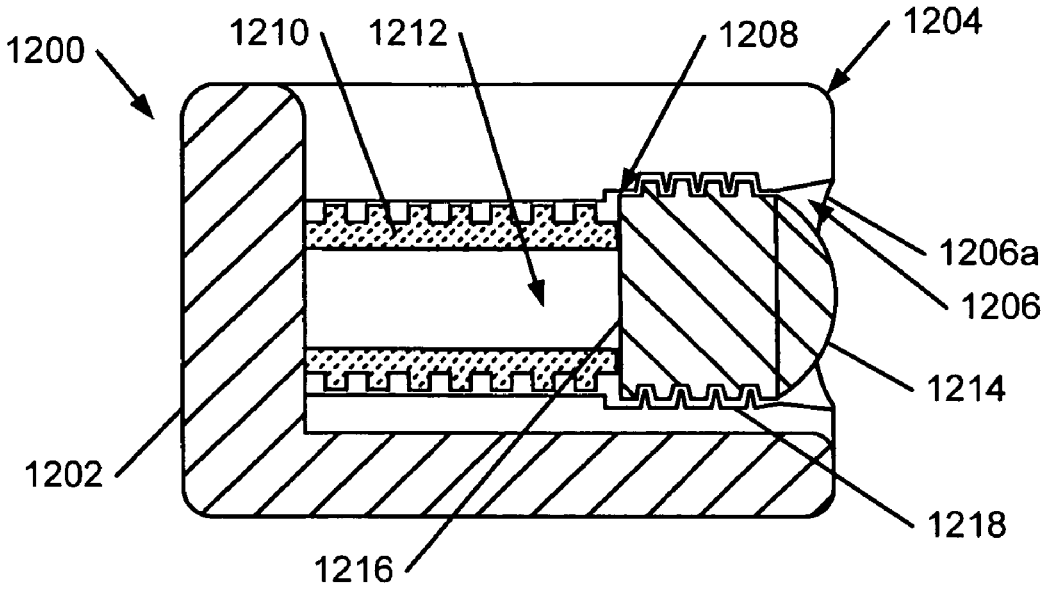
Figure 13:
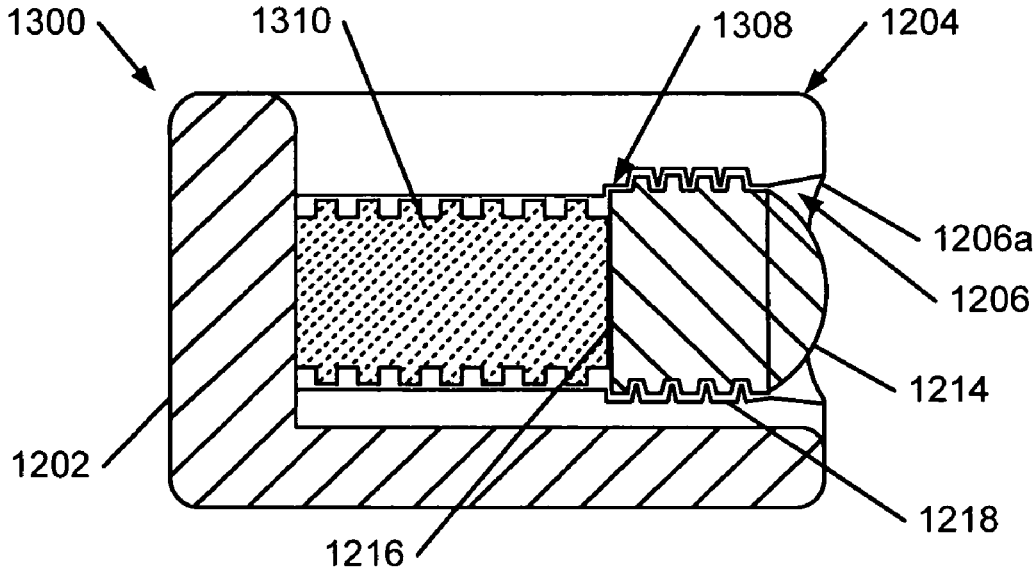

FIGS. 11-13 provide at least partial sectional views illustrating examples of means for changing the feel of a golf club head or other ball striking devices in accordance with at least some examples of this invention. In these illustrated examples, the means for changing the "feel" of the golf club head may be used to change at least one characteristic of the sound emanating from the ball striking device head when a ball is struck. In other words, the "means for changing the feel" associated with these example structures of the invention include within their scope "means for changing the sound" associated with the ball striking device when used to contact a ball.

FIG. 11 shows an example ball striking device head 1100 that includes a ball striking surface 1102, a body member or portion 1104 (which may be formed as a single piece with the ball striking surface 1102, as a separate structure from the ball striking surface 1102, as a base with a cover member, or as two or more body members, etc.). The body member 1104 in this example includes a borehole 1106 defined therein, and this borehole 1106 extends to provide an opening 1106*a* in the body member 1104. The borehole 1106 removably receives at least some portion of a means for changing the sound 1108 associated with the ball striking device head 1100.

The "means for changing the sound" 1108 of this example includes a tubular wall member 1110 that itself defines an interior or open chamber 1112. While the illustrated wall member 1110 and chamber 1112 are round in this example structure, these elements may take on any desired shape, configuration, or orientation without departing from the invention. The wall member 1110 fits within the borehole 1106 and extends away from a backside of the ball striking surface 1102 toward a rear of the ball striking device head 1100 and toward opening 1106*a*. Although it is not a requirement, in this example the front portion of the wall member 1110 directly contacts the backside of the ball striking surface 1102. If desired, an intermediate member may be included between the ball striking surface 1102 and the wall member 1110 without departing from the invention. Of course, the club head 1100 may include any number of holes 1106 and/or means for changing the sound 1108 without departing from the invention.

A second portion of the means for changing the sound 1108 of this example includes a screw or rotary member 1114. In this example, a shaft of the rotary member 1114 fits within and extends through the chamber 1112 defined by the wall member 1110, and the rotary member 1114 directly engages the backside of the ball striking surface 1102. While any type of engagement may be provided without departing from the invention, in this illustrated example the end 1116 of the shaft of the rotary member 1114 includes threads that engage with threads provided in the backside of the ball striking surface 1102. Also, in this example, a washer member 1118 or other retaining device is provided to prevent the rotary member 1114 from freely extending into the wall member 1110 and to thereby apply pressure to the wall member 1110 as will be described in more detail below. In other words, the combination of the rotary member 1114, the threaded engagement, and the washer 1118 in this example structure function as a means for applying pressure or force to the wall member 1110, as will be described in more detail below.

As illustrated in FIG. 11, the wall member 1110, rotary member 1114, and washer 1118 of the means for changing the sound are sized to fit through the opening 1106*a* and into the borehole 1106 or open area. In use, the wall member 1110 may be secured within the borehole 1106 by engaging the threads of the rotary member 1114 with the threads in the backside of the ball striking surface 1102, e.g., using a screwdriver, an allen wrench, etc, and pressing the washer 1118 against the end of wall member 1110. Once the means for changing the sound 1108 (e.g., tubular member 1110, rotary member 1114, and washer 1118) is secured in the borehole 1106, the ball striking device 1100 will have a certain sound characteristic when it strikes a ball (e.g., depending on various factors such as the thickness of the ball striking face 1102, the material of the ball striking face 1102, the material of the wall member 1110, the dimensions of the wall member 1110, etc.).

The sound emanated or issued by the ball striking device 1100 during a ball strike may be changed by "tuning" the means for changing the sound 1108. More specifically, by adjusting the rotary member 1114, a user can either increase or decrease the pressure exerted on the wall member 1110 (e.g., change the compressive force applied to the wall member 1110), which tends to increase or decrease a stiffness of the wall member 1110. This change in pressure and/or stiffness will change the vibrational characteristics associated with the wall member 1110 when a ball is struck, thereby changing the sound emanating from the ball striking device head 1100 when a ball is struck. Rotating the rotary member 1114 also may change the pressure at which the wall member 1110 contacts the backside of the ball striking surface 1102, which also may affect and change the vibrational characteristics associated with the ball striking surface 1102 when a ball is struck, thereby also affecting and changing the sound emanating from the ball striking device head 1100 when a ball is struck. By rotating the rotary member 1114, a user can freely change the sound emanating from the ball striking device head 1100, e.g., by changing the frequency or pitch of the sound, thereby customizing the sound (or "feel") of the club to suit his/her likings or preferences. If desired, the rotary member 1114, the area around the opening 1106*a*, and/or other portions of the structure may include indicia to enable a user to better control and recall the relative position of the rotary member 1114 with respect to the club head body 1114 and/or the wall member 1110.

Also, if desired, the means for changing the sound 1108 and/or any individual portion of it (e.g., rotary member 1114, washer 1118, and wall member 1110 in this example) may be freely and selectively removed from the body member 1104 of the ball striking device head 1100, e.g., via opening 1106*a*, to thereby allow further selective change or customization of the sound emanating from the ball striking device head 1100 during use. For example, if desired, the sound emanating from the ball striking device head 1100 during use may be further controlled or changed by removing one wall member 1110 (or the entire means for changing the sound 1108) and replacing it with another (e.g., one of different length, different thickness, different wall thickness, made of a different material, etc.). If desired, the entire means for changing the sound 1108 may be held together as an integral construction that is insertable into and removable from the body member 1104 as a unit. Furthermore, if desired, the "feel" of the ball striking device 1100 during use may be controlled and/or changed by removing one wall member 1110 (or the entire means for changing the sound 1108) and replacing it with a wall member 1110 of different weight or different weight distribution, to thereby change the swing and/or weight characteristics of the ball striking device head 1100.

Any type of material may be used for the wall member 1110 and/or other portions of the means for changing the sound 1108 without departing from the invention, such as metals (e.g., aluminum, titanium, steel, brass, copper, pewter, etc.); carbon fiber; polymers; etc. Also, in examples of the invention that include two or more means for changing the sound (e.g., units 1108), in at least some examples, a user may freely and independently adjust either means without departing from the invention.

FIG. 12 illustrates an alternative ball striking device head 1200, including an alternative means for changing the sound 1208, that may be used in accordance with at least some examples of this invention. In this example structure, a wall member 1210 is included within a borehole 1206 (or other open area) defined in a body member 1204 of the ball striking device 1200, but the rotary member 1214 of the means for changing the sound 1208 does not extend into the interior chamber 1212 defined in the wall member 1210. Additionally, in this example structure, the rotary member 1214 of the means for changing the sound 1208 does not directly engage the backside of the ball striking surface 1202, although the wall member 1210 does directly contact the backside of the ball striking surface 1202. Of course, if desired, one or more intermediate members may be included between the wall member 1210 and the backside of the ball striking surface 1202 without departing from the invention.

In contrast to the structure shown in FIG. 11, the ball striking device head 1200 of FIG. 12 provides a rotary member 1214 outside of and independent of the wall member 1210. The rotary member 1214 rotatably engages threads 1218 provided in the borehole 1206 wall, and its free end 1216 is sized and shaped so as to fit into the opening 1206*a* and engage the end of wall member 1210. By rotating the rotary member 1214 using the threaded connection, a user can change the compressive force applied to the wall member 1210, thereby changing the stiffness of the wall member 1210, as well as the sound characteristics (e.g., tone, frequency, pitch, etc.) emitted by the ball striking device head 1200 when a ball is struck. Additionally, as described above in conjunction with FIG. 11, at least some portions of the means for changing the sound 1208 (e.g., the rotary member 1214, the wall member 1210, any present intermediate members or washer members, etc.) may be freely and selectively removable from the ball striking device head 1200 to thereby allow the user to interchange one or more portions of the means for changing the sound 1208 for other similar devices (e.g., to make repairs, further change sound characteristics, change club head weighting, weight distribution or other swing characteristics, etc.).

The example ball striking device structure 1300 shown in FIG. 13 is similar to that shown in FIG. 12 (and hence the same reference numbers are used, where applicable), except the wall member 1310 differs. Rather than providing a tubular wall member 1210 including an open interior chamber 1212, like that illustrated in FIG. 12, the wall member 1310 of the means for changing the sound structure 1308 shown in FIG. 13 is solid (e.g., akin to a plug). Like the other wall members described above, wall member 1310 may be made of any desired material without departing from the invention, such as metals, polymers, etc. The sound emanated by the club head 1300 may be changed in various manners, including the various manners described above, such as by changing the pressure applied to the wall member 1310, changing dimensions of the wall member 1310, changing wall member 1310 materials, etc.

Of course, many variations in the wall structure 1110, 1210, or 1310 may be used without departing from the invention. For example, the wall structure may be any shape, such as round, square, rectangular, elliptical, or of any desired cross-sectional shape. Additionally, the wall members may be tubular, open on both ends, open on one end, closed on both ends with an open central region, solid, made of multiple pieces, etc. without departing from the invention. As still another example, the wall members may be designed to permanently remain within their respective body member, but if desired, the rotary member and/or other portions of the means for applying force to the wall member may be movable with respect to and/or removable from the body of club head structure without departing from the invention. The wall members also may be constructed of any desired type of material without departing from the invention including: metals (e.g., aluminum, titanium, brass, copper, pewter, etc.), carbon fibers, polymers, combinations thereof, etc.

Many variations on the means for applying the force may be used without departing from the invention. While rotary members including threaded connections are described above and illustrated in the drawings, any means or method for changing the applied force may be used. For example, a mechanical ratcheting system may be used to increase or decrease the force or pressure applied to a wall member. As another example, the means for applying the force may be located partially or fully outside of the body member such that an element at least partially external to the body member may be used to apply force against a wall member, such as by using rotary, threads, ratchet, clamp, cam, or other action to apply force to a wall member in some other manner without departing from the invention. Any other desired way of applying force to a wall member may be used without departing from the invention.

Various different structures for the means for changing the sound also may be used without departing from this invention. For example, as described above, the sound may be changed in various ways, for example, by changing the force or pressure applied to a wall member, by changing the materials or dimensions of the wall member, by changing the force or pressure applied to an intermediate member located between a wall member and the ball striking surface, by changing the materials or dimensions of an intermediate member, by changing force or pressure applied to the backside of the ball striking surface, etc. All or part of the means for changing the sound may be located outside of or external to the club head body without departing from the invention. For example, an adjustable, external clamp type device, a cam mechanism, or other mechanical structure may be applied to some portion of the body member and used to change the tone, frequency, pitch, or other sound or vibrational characteristics of the ball striking device head when a ball is struck.

Also, other ways of changing the feel of the golf club head may be used in accordance with aspects of this invention. For example, the weighting characteristics of the club head may be changed, e.g., by replacing means for changing the sound, means for applying a force, intermediate members, weighted members, and/or the like with similar members having different weights, weight distributions, and the like.

The sound or other "feel" characteristics associated with hitting balls or other objects with a club-like device are not limited to golf. For example, aspects of the invention advantageously may be used in forming: mallets used in polo or croquet; hockey sticks (field hockey or ice hockey); tennis rackets; badminton rackets; cricket bats; and the like. More generally, aspects of the invention advantageously may be used in any sporting equipment in which a bat or other club-like element is used to apply a motive force to a ball (or a similar object) and there is a desire to allow users to change or customize sound and/or other feel characteristics associated with this ball striking contact.

D. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A putter head, comprising:

a ball striking head including a ball striking surface that faces a ball in use, wherein the ball striking head includes a first opening and a second opening defined therein, wherein the first opening is separate from the second opening, the first opening and the second opening each extending from the ball striking surface toward a rear surface of the ball striking head;

a first wall member located in the first opening, wherein the first wall member includes a first end that engages a backside of the ball striking surface and a second end opposite the first end;

a second wall member located in the second opening, wherein the second wall member includes a first end that engages the backside of the ball striking surface and a second end opposite the first end;

a first means for applying a force to the first wall member, wherein the first means for applying the force engages the second end of the first wall member; and a second means for applying a force to the second wall member, wherein the second means for applying the force engages the second end of the second wall member, and wherein the forces applied to the first wall member and the second wall member may be selectively varied to alter a sound emanating from the ball striking head when a golf ball contacts the ball striking surface.

2. A putter head according to claim 1, wherein the first wall member at least partially defines a first chamber extending in a direction away from the ball striking surface.

3. A putter head according to claim 2, wherein the first means for applying the force is at least partially located in the first chamber.

4. A putter head according to claim 1, wherein the first means for applying the force includes a screw member.

5. A putter head according to claim 4, wherein the screw member applies a compressive force to the second end of the first wall member.

6. A putter head according to claim 4, wherein the screw member, at least in part, controls a stiffness characteristic of the first wall member.

7. A putter head according to claim 1, wherein the first means for applying the force extends at least partially through the first opening defined in the ball striking head.

8. A putter head according to claim 7, wherein an adjustable portion of the first means for applying the force is accessible from an exterior of the ball striking head.

9. A putter head according to claim 8, wherein the first wall member at least partially defines a first chamber extending in a direction away from the ball striking surface.

10. A putter head according to claim 9, wherein the first means for applying the force is at least partially located in the first chamber.

11. A putter head according to claim 8, wherein the first means for applying the force applies a compressive force to the second end of the first wall member.

12. A putter head according to claim 8, wherein the first means for applying the force, at least in part, controls a stiffness characteristic of the first wall member.

13. A putter head according to claim 7, wherein the first means for applying the force is selectively removable from the ball striking head.

14. A putter head according to claim 7, wherein the first wall member and the first means for applying the force are selectively removable from the ball striking head.

15. A putter head according to claim 1, wherein the first wall member at least partially defines a first chamber extending in a direction away from the ball striking surface, and wherein the second wall member at least partially defines a second chamber extending in a direction away from the ball striking surface.

16. A putter head according to claim 15, wherein the first means for applying the force is at least partially located in the first chamber, and wherein the second means for applying the force is at least partially located in the second chamber.

17. A putter head according to claim 1, wherein the first means for applying the force to the first wall member extends at least partially through the first opening defined in the ball striking head, and wherein the second means for applying the force to the second wall member extends at least partially through the second opening defined in the ball striking head.

18. A putter, comprising:

a putter head including a ball striking surface that faces a ball in use, wherein the putter head includes a first opening and a second opening defined therein, wherein the second opening is separate from the first opening, the first opening and the second opening each extending from the ball striking surface toward a rear surface of the putter head;

a first wall member located in the first opening, wherein the first wall member includes a first end that engages a backside of the ball striking surface and a second end opposite the first end;

a second wall member located in the second opening, wherein the second wall member includes a first end that engages the backside of the ball striking surface and a second end opposite the first end;

a first means for applying a force to the first wall member, wherein the first means for applying the force engages the second end of the first wall member;

a second means for applying a force to the second wall member, wherein the second means for applying the force engages the second end of the second wall member, wherein the forces applied to the first wall member and the second wall member may be selectively varied to alter a sound emanating from the ball striking head when a golf ball contacts the ball striking surface; and a shaft engaged with the putter head.

* * * * *